US010113221B2

(12) United States Patent
Huang et al.

(10) Patent No.: US 10,113,221 B2
(45) Date of Patent: Oct. 30, 2018

(54) BEARING STEEL

(71) Applicants: Hanzheng Huang, Nieuwegein (NL); Mohamed Sherif, Hilversum (NL)

(72) Inventors: Hanzheng Huang, Nieuwegein (NL); Mohamed Sherif, Hilversum (NL)

(73) Assignee: AKTIEBOLAGET SKF, Gothenburg (SE)

( * ) Notice: Subject to any disclaimer, the term of this patent is extended or adjusted under 35 U.S.C. 154(b) by 328 days.

(21) Appl. No.: 15/052,883

(22) Filed: Feb. 25, 2016

(65) Prior Publication Data

US 2016/0251744 A1 Sep. 1, 2016

(30) Foreign Application Priority Data

Feb. 27, 2015 (GB) ..... 1503357.4

(51) Int. Cl.
*C21D 9/36* (2006.01)
*C21D 6/00* (2006.01)
(Continued)

(52) U.S. Cl.
CPC ..... *C22C 38/58* (2013.01); *C21D 1/18* (2013.01); *C21D 1/20* (2013.01); *C21D 1/613* (2013.01); *C21D 6/004* (2013.01); *C21D 6/005* (2013.01); *C21D 6/007* (2013.01); *C21D 6/008* (2013.01); *C21D 9/36* (2013.01); *C22C 38/001* (2013.01);
(Continued)

(58) Field of Classification Search
None
See application file for complete search history.

(56) References Cited

U.S. PATENT DOCUMENTS 3,528,088 A 9/1970 Seghezzi et al.
6,149,743 A * 11/2000 Lund ..... C21D 1/20 148/579
(Continued)

FOREIGN PATENT DOCUMENTS

JP 02-054739 * 2/1990 ..... C22C 38/28
JP 2004150592 A 5/2004
WO WO 2008071157 A2 * 6/2008 ..... C21D 1/19

OTHER PUBLICATIONS

Machine-English translation of JP 02-054739, Nakamura Morifumi et al., Feb. 23, 1990.*
(Continued)

*Primary Examiner* — Deborah Yee
(74) *Attorney, Agent, or Firm* — Bryan Peckjian; SKF USA Inc. Patent Dept.

(57) ABSTRACT

A steel alloy for a bearing, the alloy having a composition comprising: (a) from 0.5 to 0.9 wt. % carbon, (b) from 1.2 to 1.8 wt. % silicon, (c) from 1.1 to 1.7 wt. % manganese, (d) from 0.7 to 1.3 wt. % chromium, (e) from 0.05 to 0.6 wt. % molybdenum, and optionally any of: (f1) from 0 to 0.25 wt. % nickel, (f2) from 0 to 0.02 wt. % vanadium, (f3) from 0 to 0.05 wt. % aluminium, (f4) from 0 to 0.3 wt. % copper, (f5) from 0 to 0.5 wt. % cobalt, (f6) from 0 to 0.1 wt. % niobium, (f7) from 0 to 0.1 wt. % tantalum, (f7) from 0 to 150 ppm nitrogen, (f8) from 0 to 50 ppm calcium, and (f9) the balance iron, together with any unavoidable impurities, wherein the steel alloy has a microstructure comprising bainitic ferrite and retained austenite, and a hardness (Vickers) of at least 650 HV.

12 Claims, 3 Drawing Sheets

(51) Int. Cl.

| | |
|---|---|
| ***C21D 1/20*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |
| ***C22C 38/52*** | (2006.01) |
| ***C22C 38/34*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 1/613*** | (2006.01) |
| ***C21D 1/18*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/52* (2013.01)

(56) References Cited

U.S. PATENT DOCUMENTS

| | | | | |
|---|---|---|---|---|
| 2010/0247368 | A1 | 9/2010 | Rawson et al. | |
| 2011/0052442 | A1* | 3/2011 | Sherif ..... | C21D 9/40 420/87 |
| 2011/0126946 | A1 | 6/2011 | Bhadeshia | |
| 2011/0209803 | A1 | 9/2011 | Sugimoto et al. | |
| 2015/0023623 | A1* | 1/2015 | Beswick ..... | C21D 9/40 384/492 |

OTHER PUBLICATIONS

Machine-English translation of WO 2008071157 A2, Schaeffler, KG, Jun. 19, 2008.*

* cited by examiner

BEARING STEEL

CROSS REFERENCE TO RELATED APPLICATION

This is a Non-Provisional Patent Application, filed under the Paris Convention, claiming the benefit of Great Britain (GB) Patent Application Number 1503357.4, filed on 27 Feb. 2015 (27.02.2015), which is incorporated herein by reference in its entirety.

TECHNICAL FIELD

The present invention relates generally to the field of metallurgy. More specifically, the present invention relates to a steel alloy and a method of heat-treating a steel alloy, which may be used in the manufacture of, for example, bearings.

BACKGROUND OF THE PRESENT INVENTION

Bearings are devices that permit constrained relative motion between two parts. Rolling element bearings comprise inner and outer raceways and a plurality of rolling elements (for example balls and/or rollers) disposed therebetween. For long-term reliability and performance it is important that the various elements have a high resistance to rolling contact fatigue, wear and creep.

Conventional techniques for manufacturing metal components involve hot-rolling or hot-forging to form a bar, rod, tube or ring, followed by a soft forming/machining process to obtain the desired component. Surface hardening processes are well known and are used to locally increase the hardness of surfaces of finished or semi-finished components so as to improve, for example, wear resistance and fatigue resistance. A number of surface or case hardening processes are known for improving rolling contact fatigue resistance.

An alternative to case-hardening is through-hardening. Through-hardened components differ from case-hardened components in that the hardness is uniform or substantially uniform throughout the component. Through-hardened components are also generally cheaper to manufacture than case-hardened components because they avoid the complex heat-treatments associated with carburizing, for example.

For through-hardened bearing steel components, two heat-treating methods are available: martensite hardening or austempering. Component properties such as toughness, hardness, microstructure, retained austenite content, and dimensional stability are associated with or affected by the particular type of heat-treatment employed.

The martensite through-hardening process involves austenitising the steel prior to quenching below the martensite start temperature. The steel may then be low-temperature tempered to stabilize the microstructure.

The bainite through-hardening process involves austenitising the steel prior to quenching above the martensite start temperature. Following quenching, an isothermal bainite transformation is performed. Bainite through-hardening is sometimes preferred in steels instead of martensite through-hardening. This is because a bainitic structure may possess superior mechanical properties, for example toughness and crack propagation resistance.

Bainitic steel structures are produced by the transformation of austenite to bainitic-ferrite at intermediate temperatures of typically from 190 to 500° C. The cooling of the austenite leads to a microstructure comprising ferrite, carbides and retained austenite. Bainite itself comprises a structure of supersaturated ferrite containing particles of carbide, the dispersion of the latter depending on the formation temperature. The hardness of bainite is usually somewhere intermediate between that of pearlite and martensite.

The steel known as SP10 has the following chemical composition: Fe-0.8C-1.5Si-2Mn-1Al-1Cr-0.25Mo-1.5Co in wt. %. Austenitisation followed by bainite hardening (200° C., 72 hours) results in a fine microstructure comprising retained austenite and bainitic ferrite. However, the hardness and dimensional stability of this alloy structure are deemed too low for bearing applications.

It is an object of the present invention to address some of the problems associated with the prior art, or at least to provide a commercially useful alternative thereto.

SUMMARY OF THE INVENTION

The present invention provides a steel alloy for a bearing, the alloy having a composition comprising:

A steel alloy for a bearing, the alloy having a composition comprising:

from 0.5 to 0.9 wt. % carbon,
from 1.2 to 1.8 wt. % silicon,
from 1.1 to 1.7 wt. % manganese,
from 0.7 to 1.3 wt. % chromium,
from 0.05 to 0.6 wt. % molybdenum, optionally:
from 0 to 0.25 wt. % nickel,
from 0 to 0.02 wt. % vanadium,
from 0 to 0.05 wt. % aluminium,
from 0 to 0.3 wt. % copper,
from 0 to 0.5 wt. % cobalt,
from 0 to 0.1 wt. % niobium,
from 0 to 0.1 wt. % tantalum,
from 0 to 150 ppm nitrogen,
from 0 to 50 ppm calcium,
the balance iron, together with any unavoidable impurities, wherein the steel alloy has a microstructure comprising bainitic ferrite and retained austenite and a hardness (Vickers) of at least 650 HV.

The present invention will now be described further. In the following passages different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

In the present invention, the steel alloy composition comprises from 0.5 to 0.9 wt. % carbon, preferably from 0.6 to 0.8 wt. % carbon, more preferably from 0.6 to 0.7 wt. % carbon, still more preferably from 0.65 to 0.7 wt. % carbon. In combination with the other alloying elements, this results in the desired fine bainitic structure. Carbon acts to lower the temperature at which bainite can be formed, so that a fine structure is achievable. The presence of carbon may result in the retention of carbides and/or carbonitrides during austenitisation, which may act as austenite grain refiners. When the carbon content is higher than 0.9 wt. % there is a reduction in the maximum volume fraction of the bainitic ferrite portion of the microstructure. When the carbon content is lower than 0.5 wt. % the alloys have a higher martensite start temperature.

The steel alloy composition comprises from 1.2 to 1.8 wt. % silicon, preferably from 1.3 to 1.7 wt. % silicon, more preferably from 1.4 to 1.6 wt. % silicon. In combination with the other alloying elements, this results in the desired fine bainitic structure with a minimum amount of retained austenite. Silicon helps to suppress the precipitation of cementite and carbide formation. However, too high a silicon content may result in undesirable surface oxides and a poor surface finish. For this reason, the maximum silicon content is 1.8 wt. %.

The steel alloy composition comprises from 1.1 to 1.7 wt. % manganese, preferably from 1.2 to 1.6 wt. % manganese, more preferably from 1.3 to 1.5 wt. % manganese. Manganese acts to increase the stability of austenite relative to ferrite. However, manganese levels above 1.7 wt. % may serve to increase the amount of retained austenite and to decrease the rate of transformation to bainite. Manganese also acts to improve hardenability.

The steel composition comprises from 0.7 to 1.3 wt. % chromium, preferably from 0.8 to 1.2 wt. % chromium, more preferably from 0.9 to 1.1 wt. % chromium. Chromium acts to increase hardenability and reduce the bainite start temperature. Chromium may also be beneficial in terms of corrosion resistance and may help to resist structural decay.

The steel composition comprises from 0.05 to 0.6 wt. % molybdenum, preferably from 0.1 to 0.5 wt. % molybdenum, more preferably from 0.15 to 0.4 wt. % molybdenum, still more preferably from 0.2 to 0.3 wt. % molybdenum. Molybdenum acts to avoid austenite grain boundary embrittlement owing to impurities such as, for example, phosphorus. Molybdenum also acts to increase hardenability and reduce the bainite start temperature. The molybdenum content in the alloy is preferably no more than about 0.6 wt. %, otherwise the austenite transformation into bainitic ferrite may cease too early, which can result in significant amounts of austenite being retained in the structure.

The steel composition may optionally comprise up to 0.02 wt. % vanadium, for example from 0.003 to 0.02 wt. % vanadium, preferably from 0.003 to 0.01 wt. % vanadium, more preferably from 0.004 to 0.008 wt. % vanadium, still more preferably from 0.005 to 0.007 wt. % vanadium. Vanadium forms carbides (and optionally nitrides and/or carbonitrides), which is important to achieve good hardness for bearing applications. Also, the vanadium may help to prevent any possible excessive austenite grain growth during hardening.

The steel composition may optionally comprise up to 0.25 wt. % nickel, for example from 0.05 to 0.25 wt. % nickel, preferably from 0.08 to 0.2 wt. % nickel.

The steel composition may optionally comprise up to 0.3 wt. % copper, for example from 0.05 to 0.3 wt. % copper, preferably from 0.1 to 0.2 wt. % copper.

The steel composition may optionally comprise up to 0.05 wt. % aluminium, for example from 0.005 to 0.05 wt. % aluminium or from 0.01 to 0.03 wt. % aluminium. Aluminium may improve the intrinsic toughness of a bearing component, possibly due to it suppressing carbide formation. Aluminium may also serve as a deoxidizer. However, the use of aluminium requires stringent steel production controls to ensure cleanliness and this increases the processing costs. Generally, therefore, the steel alloy comprises no more than 0.05 wt. % aluminium.

The steel alloy may be cobalt-free. This means that the alloy contains ≤0.01 wt. % cobalt, preferably 0 wt. % cobalt. Alternatively, the steel alloy may optionally comprise up to 0.5 wt. % cobalt, for example from 0.01 to 0.1 wt. % cobalt. While cobalt is preferably kept to a minimum in view of costs, small levels of cobalt may serve to improve the hardness of the final product. However, in the present invention, a high hardness can be achieved even in the absence of cobalt. Therefore, to reduce costs, the alloy composition preferably does not contain deliberate additions of cobalt.

In some embodiments, nitrogen may be added such that the steel alloy comprises from 50 to 150 ppm nitrogen, preferably from 75 to 100 ppm nitrogen. The presence of nitrogen may be beneficial for promoting the formation of complex nitrides and/or carbonitrides. In other embodiments, there is no deliberate addition of nitrogen. Nevertheless, the alloy may necessarily still comprise at up to 50 ppm nitrogen due to exposure to the atmosphere during melting.

The steel alloy composition may optionally comprise up to 0.1 wt. % niobium, preferably from 0.001 to 0.05 wt. % niobium, more preferably from 0.001 to 0.03 wt. % niobium; and/or optionally up to 0.1 wt. % tantalum, preferably from 0.001 to 0.05 wt. % tantalum. Niobium and tantalum may act to control the austenite grain size.

As noted above, the steel composition may also optionally include one or more of the following elements:

from 0 to 0.25 wt. % nickel (for example 0.05 to 0.2 wt. % nickel)

from 0 to 0.3 wt. % copper (for example 0.05 to 0.2 wt. % copper)

from 0 to 0.5 wt. % cobalt (for example 0.01 to 0.1 wt. % cobalt)

from 0 to 0.05 wt. % aluminium (for example 0.01 to 0.04 wt. % aluminium)

from 0 to 0.1 wt. % niobium (for example 0.025 to 0.05 wt. % niobium)

from 0 to 0.1 wt. % tantalum (for example 0.025 to 0.05 wt. % tantalum)

from 0 to 150 ppm nitrogen (for example 50 to 150 ppm nitrogen)

It will be appreciated that the steel alloy referred to herein may contain unavoidable impurities, although, in total, these are unlikely to exceed 0.3 wt. % of the composition. Preferably, the alloys contain unavoidable impurities in an amount of not more than 0.1 wt. % of the composition, more preferably not more than 0.05 wt. % of the composition. In particular, the steel composition may also include one or more impurity elements. A non-exhaustive list of impurities includes, for example:

from 0 to 0.025 wt. % phosphorous
from 0 to 0.015 wt. % sulphur
from 0 to 0.04 wt. % arsenic
from 0 to 0.075 wt. % tin
from 0 to 0.075 wt. % antimony
from 0 to 0.002 wt. % lead
from 0 to 0.002 wt. % boron The steel alloy composition preferably comprises little or no sulphur, for example from 0 to 0.015 wt. % sulphur.

The steel alloy composition preferably comprises little or no phosphorous, for example from 0 to 0.025 wt. % phosphorous.

The steel composition preferably comprises ≤15 ppm oxygen. Oxygen may be present as an impurity. The steel composition preferably comprises ≤30 ppm titanium. Titanium may be present as an impurity. The steel composition preferably comprises ≤20 ppm boron. The steel composition preferably comprises ≤50 ppm calcium. Calcium may be present as an impurity.

The steel alloy composition may consist essentially of the recited elements. It will therefore be appreciated that in addition to those elements that are mandatory other non-specified elements may be present in the composition provided that the essential characteristics of the composition are not materially affected by their presence.

The steel alloy according to the present invention preferably has a microstructure comprising bainite and a small amount of retained austenite. The microstructure may further comprise small amounts of one or more carbides, nitrides and/or carbonitrides.

The steel alloy may exhibit high hardness and/or dimensional stability. This means that the steel alloy can usefully find application in the manufacture of, for example, a bearing component such as, for example, an inner or outer raceway. The steel alloy is typically a bearing steel alloy.

In greater detail, the microstructure of the heat-treated steel alloy typically comprises nano-structured bainitic ferrite and retained austenite. The microstructure is typically substantially carbide-free, although small amounts of one or more carbides, nitrides and/or carbonitrides may be present. The microstructure may optionally contain some tempered martensite, particularly if a mixed martensitic/bainitic structure is desired.

In particular, the microstructure typically comprises at least 70 vol. % bainite, more typically at least 80 vol. % bainite, still more typically at least 90 vol. % bainite (bainitic-ferrite). The bainite is preferably lower bainite and preferably has a very fine structure. In particular, the material preferably has a microstructure comprising plates of bainitic-ferrite of less than 200 nm, typically from 10 to 100 nm, more typically from 20 to 80 nm. The plates of bainitic-ferrite are typically interspersed with retained austenite. The bainite typically forms at least 60% of the microstructure (by volume), more typically at least 80%, still more typically at least 90%.

The microstructure of the steel alloy preferably comprises less than 15 vol. % retained austenite, more preferably less than 12 vol. % retained austenite, still more preferably less than 10 vol. % retained austenite, for example 5 to 10 vol. %. The low level of retained austenite is advantageous in that it improves dimensional stability of a bearing component.

The microstructure may also contain small carbide, nitride and/or carbo-nitride precipitates, for example nano-scale precipitates, typically 5-30 nm average size. Any such precipitates typically make up no more than 5 vol. %, more typically no more than 3 vol. % of the microstructure, for example from 0.5 to 3 vol. %.

The structure of the steel alloys may be determined by conventional microstructural characterisation techniques such as, for example, optical microscopy, TEM, SEM, AP-FIM, and X-ray diffraction, including combinations of two or more of these techniques.

According to another aspect of the present invention there is provided a bearing component, comprising a steel alloy as herein described. Examples of bearing components where the steel can be used include a rolling element (e.g. ball, cylinder or tapered rolling element), an inner ring, and an outer ring. The present invention also provides a bearing comprising a bearing component as herein described.

The present invention will now be described further with reference to a suitable heat treatment for the steel alloy, provided by way of example.

The composition and microstructure result in good mechanical properties for bearing applications. For example, a hardness of 681 HV can be achieved.

According to a further aspect, there is provided a method of heat-treating a steel alloy comprising:

(i) providing a steel alloy composition comprising:
from 0.5 to 0.9 wt. % carbon,
from 1.2 to 1.8 wt. % silicon,
from 1.1 to 1.7 wt. % manganese,
from 0.7 to 1.3 wt. % chromium,
from 0.05 to 0.6 wt. % molybdenum, optionally:
from 0 to 0.25 wt. % nickel,
from 0 to 0.02 wt. % vanadium,
from 0 to 0.05 wt. % aluminium,
from 0 to 0.3 wt. % copper,
from 0 to 0.5 wt. % cobalt,
from 0 to 0.1 wt. % niobium,
from 0 to 0.1 wt. % tantalum,
0 to 150 ppm nitrogen,
0 to 50 ppm calcium, the balance iron, together with any unavoidable impurities, (ii) heating the composition to a temperature of at least 865° C. to at least partially austenetise the composition;

(iii) quenching the composition to a first temperature T1, wherein $0.7M_s \leq T1 \leq 1.6M_s$, $M_s$ being the martensite start temperature of the austenite composition; and (iv) heating the composition to a second temperature T2 below the bainite start temperature of the austenite composition $B_s$.

The term "martensite start temperature" as used herein refers to the temperature at which the transformation from austenite to martensite begins on cooling. The martensite start temperature is typically denoted Ms.

The term "bainite start temperature" as used herein refers to the highest temperature at which ferrite can transform by a displacive transformation. The bainite start temperature is typically denoted $B_s$.

The resulting alloy exhibits high hardness and/or dimensional stability. This means that it can usefully find application in the manufacture of, for example, a bearing component such as, for example, an inner or outer raceway or a rolling element.

The steel alloy composition described in the first aspect of the present invention, in all of its embodiments, is equally applicable to this further aspect.

As noted above, the microstructure of the resulting steel alloy typically comprises nano-structured bainitic ferrite and retained austenite. Steps (iii) and (iv) of the method of the present invention typically result in bainite transformation. This bainite transformation is typically carried out at a temperature of less than 300° C., more typically less than 280° C. One result of the low transformation temperature is that the plates of bainitic-ferrite are very fine. In particular, the material preferably has a microstructure comprising plates of bainitic-ferrite of less than 200 nm, typically from 10 to 100 nm, more typically from 20 to 80 nm.

Following steps (i) to (iii), the steel alloy composition is heated to a second temperature T2 below the bainite start temperature of the austenite composition $B_s$. This heating step (iv) results in an acceleration of the bainite transformation kinetics. As a result of this acceleration, for the same transformation time at temperature, the final steel alloy typically contains less retained austenite. This results in increased strength and hardness, and better dimensional stability. The dimensional stability is critical when the steel alloy is in the form of a bearing component, which operate at warm-to-elevated temperatures, typically 80° C. and above. The amount of retained austenite is typically less than 15 vol. %, more typically less than 12 vol. %, even more typically less than 10 vol. %. In one embodiment, the amount of retained austenite is about 8 vol. %.

In addition, the acceleration of the bainite transformation kinetics may result in a shorter transformation time for a given retained austenite content in the final alloy structure.

For example, in comparison to a conventional heat treatment (for example, austenitisation followed by heating at 200° C. for 72 hours), the overall bainite transformation time of the method of the present invention may be reduced by at least 12 hours. This may result in significant cost and time savings.

In step (ii), the composition is heated to a temperature of at least 865° C. to at least partially austenise the composition. In a typical embodiment, the composition may be heated to a temperature of from 865 to 900° C., more typically from 870 to 880° C. The composition is typically held at such temperatures for at least 50 minutes, typically 50 to 100 minutes. This step is important in order to achieve the desired fine bainitic microstructure with a low level of retained austenite.

In one embodiment, T1 is above the martensite start temperature. This may result in deformation of the residual austenite, i.e. the induction of internal stresses. During the subsequent step (iv), the bainite transformation may be substantially accelerated. Accordingly, in comparison to a conventional bainite transformation step of heating at 200° C. for 72 hours, the overall bainite transformation time of the method described herein may be particularly shortened.

In this embodiment, T1 is preferably from 190 to 210° C., more preferably about 200° C. Such temperatures are suitable for deforming the retained austenite as well as ensuring sufficiently fine bainitic structure.

In this embodiment, during step (iii), the composition is preferably held at T1 for at least 5 hours, more preferably from 12 to 36 hours, even more preferably from 12 to 24 hours, still even more preferably from 12 to 16 hours. The time at which the composition is held at T1 is preferably minimised in view of cost. Holding the composition at T1 for at least 5 hours, preferably at least 12 hours, may result in particularly advantageous levels of retained austenite deformation.

In an alternative embodiment, T1 is below the martensite start temperature. This may result in the presence of small amounts of martensite in the final steel alloy, thereby increasing the strength and hardness. In addition, the martensitic transformation may result in an increase in austenite deformation. Since the martensitic transformation is immediate, it is not necessary to hold the alloy composition at T1 for long periods of time. Accordingly, the composition is typically held at T1 for less than 30 minutes, preferably about 15 minutes or less. In this embodiment, the microstructure of the resulting steel alloy preferably comprises from 10 to 50 vol. % martensite, more preferably from 15 to 40 vol. % martensite, the remainder being bainitic ferrite and retained austenite.

T2 at its upper limit may be just below the bainite start temperature. T2 is preferably from 50 to 150° C. below the bainite start temperature, more preferably from 90 to 110° C. below the bainite start temperature. T2 is preferably from 200 to 280° C., more preferably from 210 to 260° C., even more preferably about 250° C. Lower temperatures may result in only a minimal reduction in the retained austenite levels of the resulting steel alloys. Higher temperatures are preferably avoided in view of cost and the somewhat weaker structure obtained. It should be noted that the bainite start temperature for the second step of transformation may change as the austenite gets enriched in carbon during the first bainite transformation step.

During step (iv) the composition is typically heated isothermally.

The method may further comprise (v) cooling the composition to room temperature.

Preferably the method further comprises (vi) cooling the composition to a temperature of less than 0° C. This may reduce the austenite content of the resulting steel alloy, thereby increasing its strength, hardness and dimensional stability.

Preferably the method further comprises (vii) tempering at a temperature of from 100 to 200° C. for at least one hour. Such tempering may serve to reduce the occurrence of cracking in the resulting steel alloy. Preferably, such tempering is carried out after step (vi). In a preferred embodiment, the composition is double or triple tempered with freezing (step (vi)) in between tempering steps. When both steps (vi) and (vii) are carried out, the steel alloy composition is typically allowed to cool to room temperature before subsequent freezing. In addition, the final tempering step is typically followed by air cooling to room temperature.

The method preferably further comprises (viii) subjecting the steel alloy to a surface finishing technique. The hardened bearing steel components may optionally be burnished, especially the raceways, followed by tempering and air-cooling. Afterwards, the bearing steel components are finished by means of hard-turning and/or grinding operations such as lapping and honing.

The burnishing and tempering operations may cause the yield strength of the affected areas to increase dramatically with significant improvement in hardness, compressive residual stress and better resistance to rolling contact fatigue.

The steel alloy composition may be a bearing steel alloy. The steel alloy may be in the form of a bearing component, preferably at least one of a rolling element, an inner ring, and an outer ring.

In a further aspect, the present invention provides a steel alloy or a bearing component produced according to the method described herein.

BRIEF DESCRIPTION OF THE DRAWINGS

The invention will now be described further, by way of example, with reference to the following non-limiting Figures, in which.

DETAILED DESCRIPTION OF THE PRESENT INVENTION

The present invention will now be described further with reference to the following non-limiting examples.

A steel with the chemical composition 0.67C-1.53Si-1.42Mn-1Cr-0.12Ni-0.25Mo-0.13Cu-0.006V-0.028Al, in wt. %, was used in the present work. The balance is made of iron together with any unavoidable impurities.

After a full-annealing heat treatment to soften the structure for improved machinability, the steel was austenitised at 870° C., in a dilatometer, and soaked at this temperature for 50 minutes. Thereafter, the specimen was gas-quenched, using nitrogen gas, to a temperature of 200° C., and held at this temperature for 72 hours until the bainite transformation has ceased. Finally, the specimen was allowed to cool to room temperature.

Figure 1:
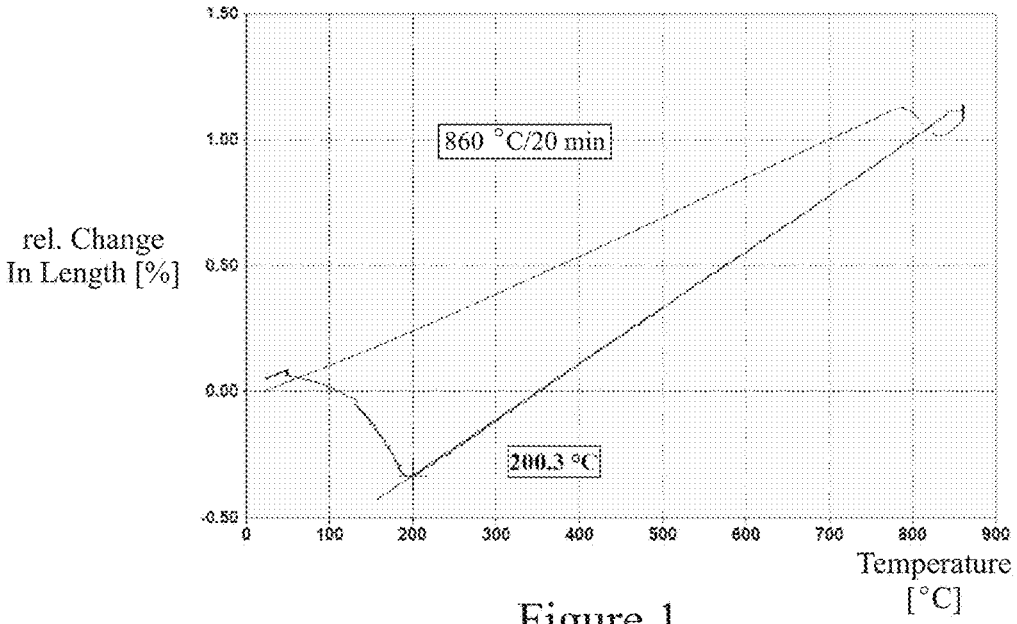
FIG. 1 is a plot of change in length against temperature for dilatometer measurements (austenitising temperature 860° C./20 minutes).
Figure 2:
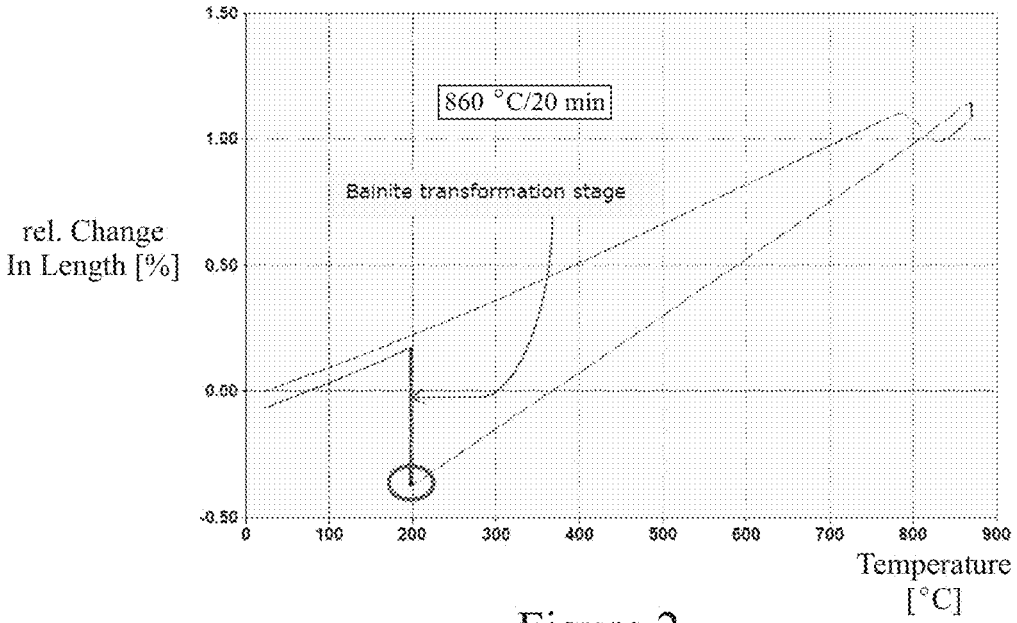
FIG. 2 is a plot of change in length against temperature for dilatometer measurements (austenitising temperature 870° C./50 minutes).
Figure 3:
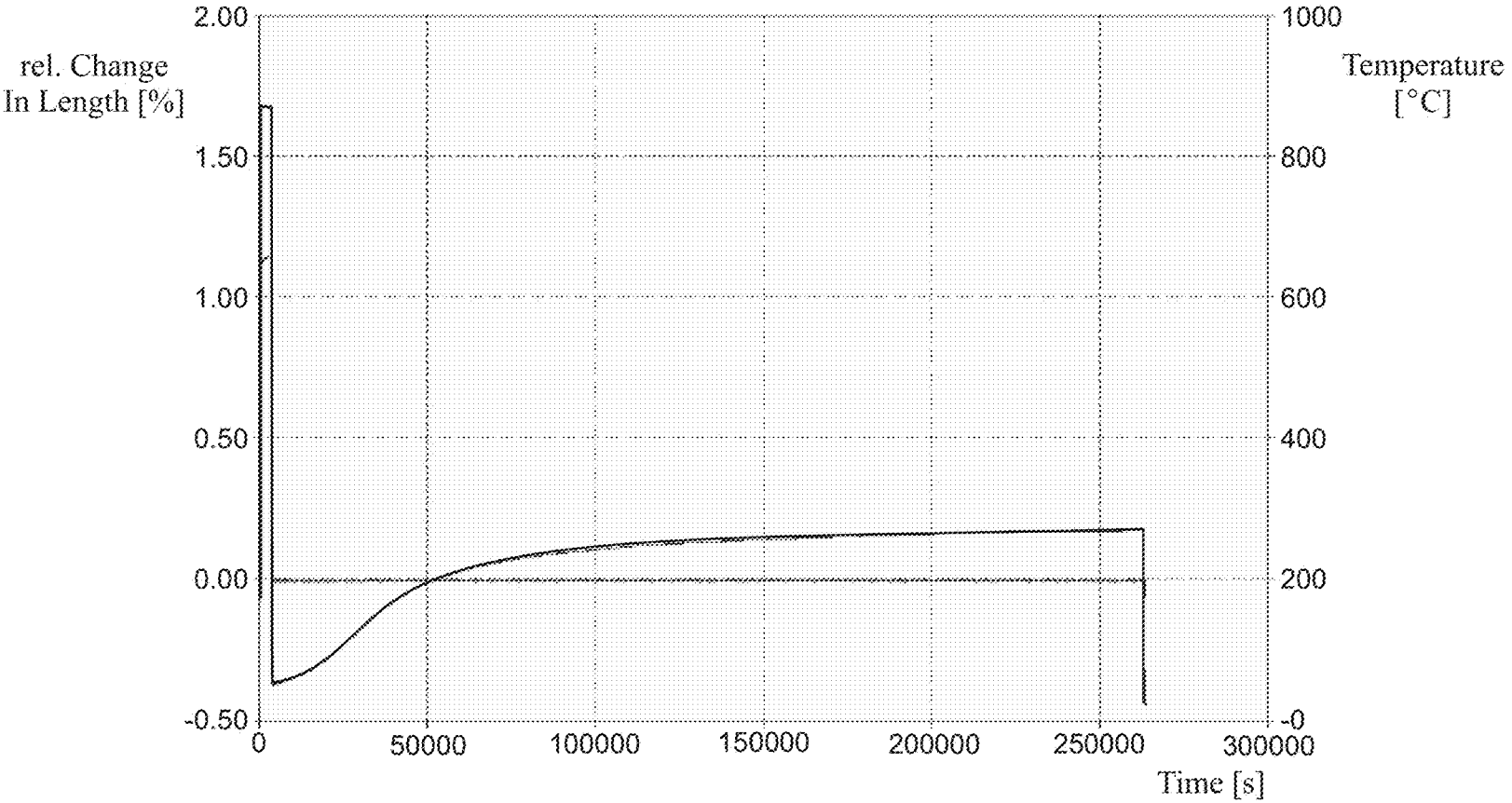
FIG. 3 is a plot of change in length against time for dilatometer measurements (austenitising temperature 870° C./50 minutes).

Austenitising at 870° C. for 50 min was found to be important to ensure that the martensite start temperature of the austenite matrix, the MS temperature, is depressed sufficiently below the intended bainite transformation temperature. Initially, holding a similar specimen at 860° C. for 20 minutes resulted in the experimentally measured MS temperature of about 200° C., upon quenching (see FIG. 1). In contrast, as shown in FIG. 2, for the sample austenitised at 870° C., no dilatation (circled), which signifies the martensite transformation, was observed in the measured dilatometer curve prior to the bainite transformation. The bainite transformation stage may be seen more clearly in FIG. 3.

Figure 4:
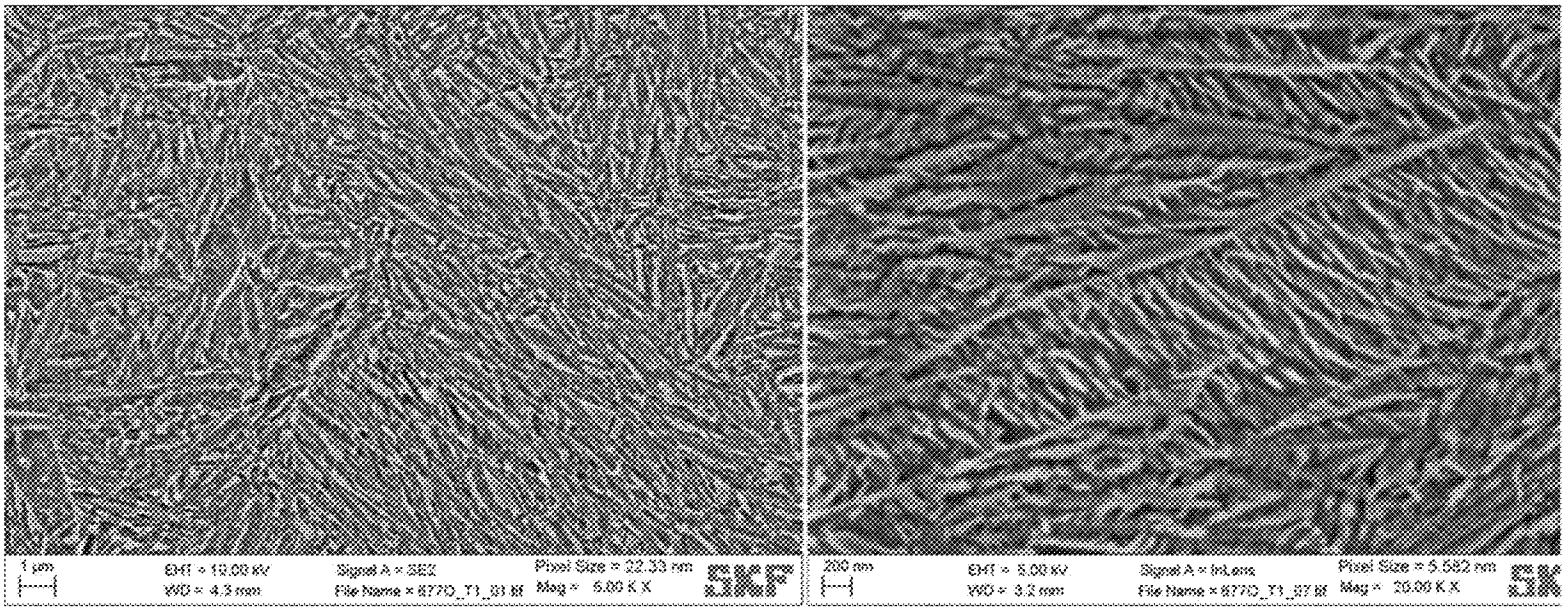
FIG. 4 are electron micrographs showing a fine bainitic microstructure with a small amount (approx. 8 vol. %) of retained austenite.

FIG. 4 shows a typically fine bainitic structure that was obtained according to the specified heat treatment on the alloy of this example. X-ray measurements showed the presence of only approximately 8 vol. % retained austenite.

The very fine bainitic structure results in very high toughness and hardness. The low level of retained austenite in the bainitic-hardened structure results in improved dimensional stability.

Hardness measurements performed after the heat treatments gave a hardness of 681 HV (average of 3 measurements). This is approximately 50 HV higher than previous heat-treated alloys.

This difference in hardness equates to an increase of about 2 HRC (Rockwell Hardness). The alloy's hardness of at least 59 HRC exceeds the minimum required 58 HRC for bearing applications.

The foregoing detailed description has been provided by way of explanation and illustration, and is not intended to limit the scope of the appended claims. Many variations in the presently preferred embodiments illustrated herein will be apparent to one of ordinary skill in the art, and remain within the scope of the appended claims and their equivalents.

What is claimed is:

1. A method of heat treating a bearing component composed of a steel alloy composition that comprises:

0.6 to 0.7 wt. % carbon,
1.3 to 1.7 wt. % silicon,
1.2 to 1.6 wt. % manganese,
0.8 to 1.2 wt. % chromium,
0.15 to 0.4 wt. % molybdenum,
0.05 to 0.25 wt. % nickel,
0.003 to 0.01 wt. % vanadium,
0.005 to 0.05 wt. % aluminium,
0.05 to 0.3 wt. % copper,
0 to 0.5 wt. % cobalt,
0 to 0.1 wt. % niobium,
0 to 0.1 wt. % tantalum,
0 to 150 ppm nitrogen, and
0 to 50 ppm calcium,
the balance being iron and 0.3 wt. % or less of unavoidable impurities, the method comprising:

(i) heating the steel alloy composition at a temperature of 865-900° C. for 50-100 minutes to at least partially austenitise the composition;

(ii) quenching the steel alloy composition to a temperature of 190-210° C. and holding the steel alloy composition at the temperature of 190-210° C. for 12-36 hours;

(iii) isothermally heating the steel alloy composition at a temperature of 200-280° C. until the steel alloy composition has a microstructure that comprises 5 to 10 vol.% retained austenite and at least 80 vol. % bainitic-ferrite and has a Vickers hardness of at least 650 HV; and (iv) subjecting the bearing component having 5 to 10 vol.% retained austenite and at least 80 vol. % bainitic-ferrite to a surface finishing technique.

2. The method of claim 1, wherein the at least 80 vol. % bainitic-ferrite is at least 80 vol. % lower bainite.

3. The method of claim 2, wherein step (i) is performed at 865-880° C. for 50-100 minutes.

4. The method of claim 3, wherein step (ii) is performed for 12-16 hours.

5. The method of claim 4, wherein the steel alloy composition consists of:

0. 65 to 0.7 wt. % carbon,
1.4 to 1.6 wt. % silicon,
1.3 to 1.5 wt. % manganese,
0.9 to 1.1 wt. % chromium,
0.2 to 0.3 wt. % molybdenum,
0.08 to 0.2 wt. % nickel,
0.005 to 0.007 wt. % vanadium,
0.01 to 0.03 wt. % aluminium,
0.1 to 0.2 wt. % copper,
0 to 0.1 wt. % cobalt,
0 to 0.1 wt. % niobium,
0 to 0.1 wt. % tantalum,
0 to 150 ppm nitrogen, and
0 to 50 ppm calcium,
the balance being iron and 0.1 wt. % or less unavoidable impurities.

6. The method of claim 1, wherein step (i) is performed at 865-880° C. for 50-100 minutes.

7. The method of claim 1, wherein step (ii) is performed for 12-16 hours.

8. The method of claim 1, wherein the steel alloy composition consists of:

0.65 to 0.7 wt. % carbon,
1.4 to 1.6 wt. % silicon,
1.3 to 1.5 wt. % manganese,
0.9 to 1.1 wt. % chromium,
0.08 to 0.2 wt. % nickel,
0.01 to 0.03 wt. % aluminium,
0.1 to 0.2 wt. % copper,
0 to 0.1 wt. % cobalt,
0 to 0.1 wt. % niobium,
0 to 0.1 wt. % tantalum,
0 to 150 ppm nitrogen, and
0 to 50 ppm calcium,
the balance being iron and 0.1 wt. % or less unavoidable impurities.

9. The method of claim 1, wherein the steel alloy composition consists, in wt. %, of 0.67C, 1.53Si, 1.42Mn, 1Cr, 0.12Ni, 0.25Mo, 0.13Cu, 0.006V, and 0.028Al, the balance being iron and unavoidable impurities.

10. The method of claim 9, wherein the at least 80 vol. % bainitic-ferrite is at least 80 vol. % lower bainite.

11. The method of claim 10, wherein step (i) is performed at 865-880° C. for 50-100 minutes.

12. The method of claim 11, wherein step (ii) is performed for 12-16 hours.

* * * * *